US008061319B2

(12) United States Patent
Kridner

(10) Patent No.: US 8,061,319 B2
(45) Date of Patent: Nov. 22, 2011

(54) CAMSHAFT PHASER FOR INTERNAL COMBUSTION ENGINE

(75) Inventor: Wesley Kridner, Canton, MI (US)

(73) Assignee: Ford Global Technologies, Dearborn, MI (US)

( * ) Notice: Subject to any disclaimer, the term of this patent is extended or adjusted under 35 U.S.C. 154(b) by 209 days.

(21) Appl. No.: 12/508,660

(22) Filed: Jul. 24, 2009

(65) Prior Publication Data

US 2010/0242879 A1 Sep. 30, 2010

Related U.S. Application Data

(60) Provisional application No. 61/165,032, filed on Mar. 31, 2009.

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

2007/0175425 A1* 8/2007 Berndorfer ..... 123/90.17
2008/0230025 A1* 9/2008 Ikihara et al. ..... 123/90.17
* cited by examiner

*Primary Examiner* — Zelalem Eshete
(74) *Attorney, Agent, or Firm* — Jerome R. Drouillard; Julia Voutyras

(57) ABSTRACT

A camshaft phaser for an internal combustion engine includes a rotor which is rotationally coupled to a camshaft and a hydraulic positioning system for timing the rotor and camshaft with respect to the crankshaft of an engine. A bypass circuit permits hydraulic fluid, such as engine lubricating oil, to flow through at least a portion of the phaser without affecting timing of the camshaft with respect to the crankshaft. In this manner, the phaser may be warmed up rapidly, without adversely affecting engine operation.

8 Claims, 3 Drawing Sheets

CAMSHAFT PHASER FOR INTERNAL COMBUSTION ENGINE

CROSS REFERENCE TO RELATED APPLICATIONS

This application claims priority to Provisional Patent Application No. 61/165,032, filed Mar. 31, 2009, the entire disclosure of which is hereby incorporated by reference and relied upon.

BACKGROUND OF THE DISCLOSURE

Internal combustion engines, and more precisely, automotive internal combustion engines, are frequently equipped with one or more camshaft phasers. A purpose of camshaft phasers is to control the timing of a cylinder poppet valve actuating camshafts with respect to the engine's crankshaft. Control of cylinder valve timing, whether applied to intake valves only, or exhaust valves only, or both, is desirable to minimize regulated engine exhaust emissions, while promoting greater fuel efficiency and driveability. Known phasers utilize hydraulic fluid, commonly in the form of engine lubricating oil, to assist in positioning the phaser components relative to one another, while simultaneously positioning the engine's camshaft with respect to the crankshaft.

Those skilled in the art understand that engine lubricating oil may become quite viscous at lower ambient temperatures, particularly when a vehicle is parked with the engine off for periods of time at lower ambient temperatures. Unfortunately, some camshaft phasers exhibit slow response characteristics upon initial startup of a cold engine because oil remaining in the phaser at engine shutdown becomes undesirably viscous.

It would be desirable to provide a system and method for allowing a camshaft phaser's actuating fluid, including, where applicable, engine lubricating oil, to circulate through a phaser prior to activation of the phaser during an engine operating event, so as to allow to the phaser, and more importantly, the oil in the phaser, to be warm and hence, properly responsive to the commands of the engine controller.

SUMMARY

According to an aspect of the present disclosure, a camshaft phaser for an internal combustion engine includes a rotor which is rotationally coupled to a camshaft and a hydraulic positioning system for timing the rotor and the camshaft with respect to the crankshaft of an engine. A bypass circuit permits hydraulic fluid to flow through at least a portion of the phaser without affecting the timing of the camshaft with respect to the crankshaft. The hydraulic positioning system preferably includes a hydrostatic positioning system. According to another aspect of the present disclosure, a camshaft phaser further includes a mechanical locking device for maintaining the rotor and camshaft at a predetermined timing value with respect to the crankshaft when the oil bypass circuit is active, so as to permit hydraulic fluid to flow through the phaser without affecting the engine's camshaft and valve timing.

According to another aspect of the present disclosure, a method for operating a camshaft phaser for an internal combustion engine includes determining engine temperature, and in the event that engine temperature is less than a predetermined value, maintaining the phaser in a predetermined cold operating position, while circulating a warming fluid through the phaser at least when the phaser is being maintained in the cold operating position. The warming fluid may be constituted as either engine lubricating oil or as a specially dedicated hydraulic fluid.

It is an advantage of a system and method according to the present disclosure that problems associated with hydrostatically positioned and other types of hydraulically actuated engine camshaft phasers will be avoided when such devices are operated at lower ambient temperatures.

It is yet another advantage of a method and system according to the present disclosure that quiet, vibration-free engine operation is promoted through the use of the present system.

Other advantages, as well as features of the present system, will become apparent to the reader of this specification.

DETAILED DESCRIPTION OF THE PREFERRED EMBODIMENTS

Figure 1:
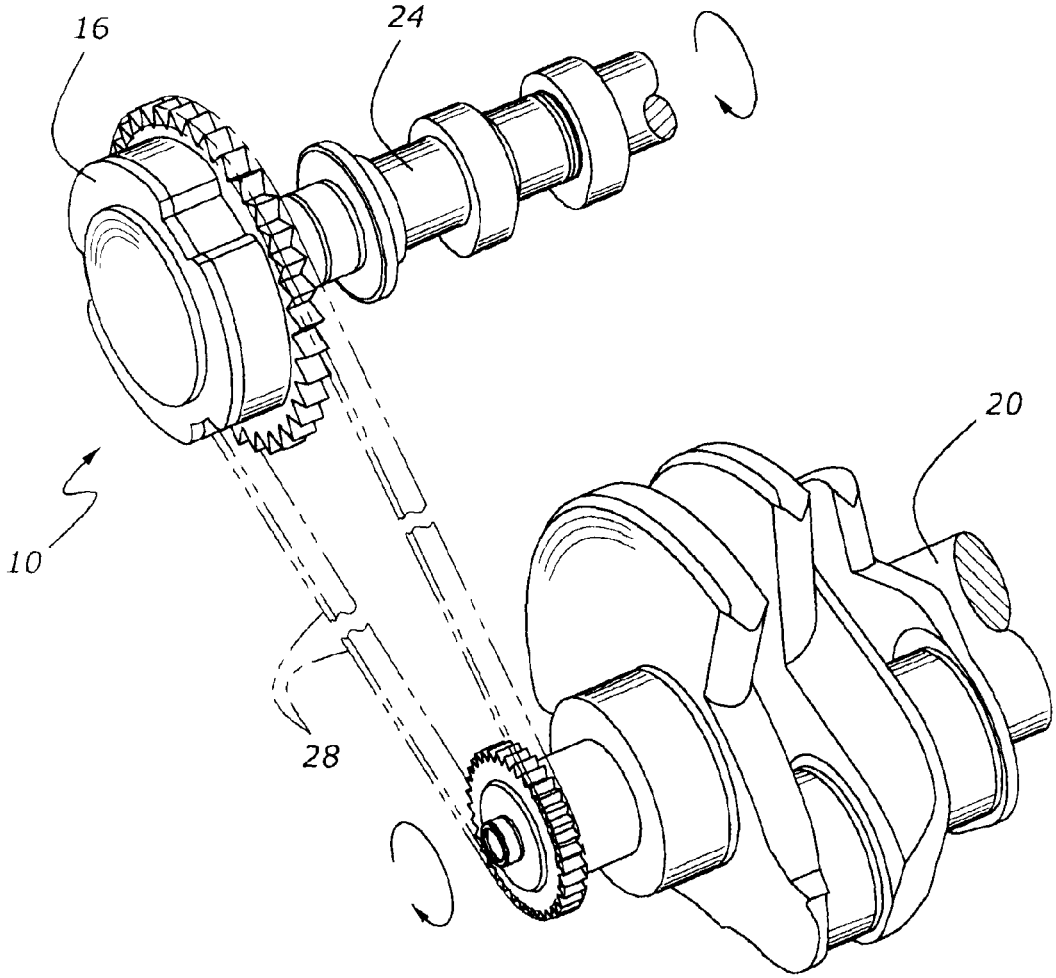
FIG. 1 is a partially schematic representation of an engine having a camshaft phaser according to the present disclosure.

FIG. 1 shows a camshaft operating system having a phaser, 10, according to the present disclosure. An engine crankshaft, 20, drives phaser 10 with a flexible drive element, 28, which may include either a belt or a chain. Phaser 10 is rotationally coupled to a cylinder poppet valve operating camshaft, 24. In a four-stroke cycle engine, crankshaft 20 rotates camshaft 24 at precisely one half of the crankshaft speed. In a two-stroke cycle engine, camshaft 24 and crankshaft 20 would rotate at the same speed.

Figure 2:
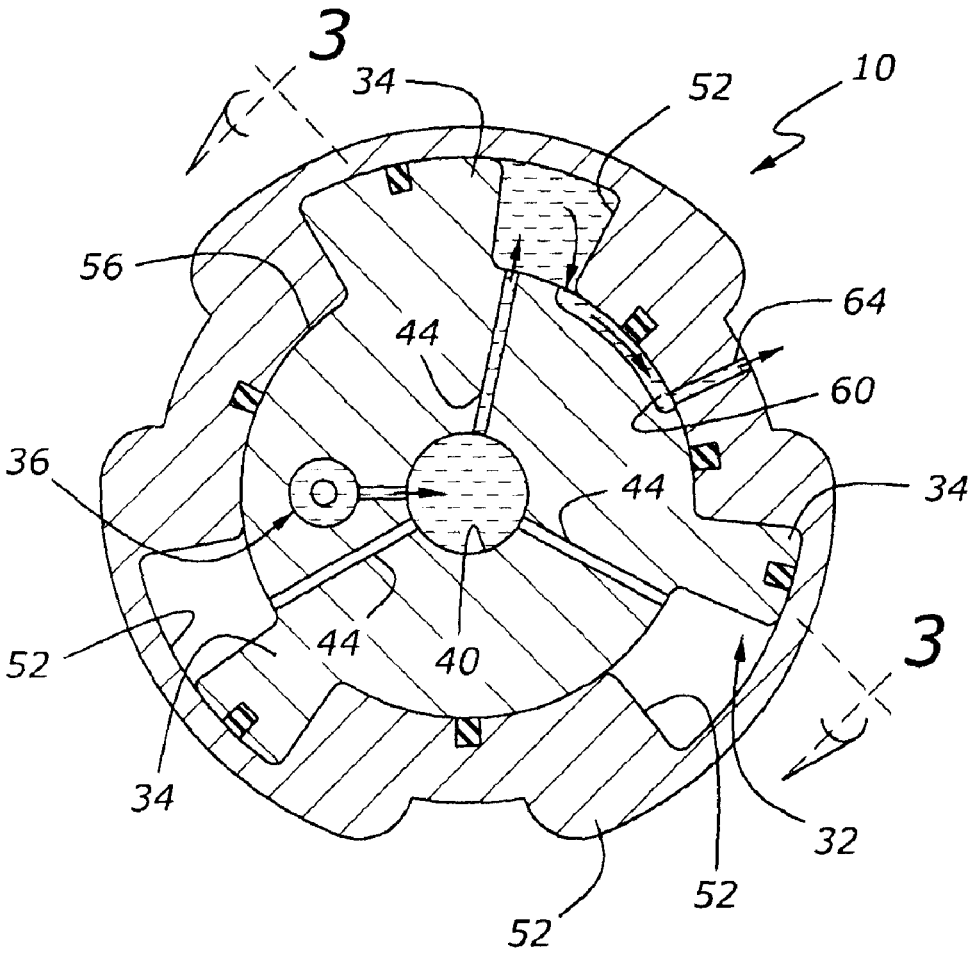
FIG. 2 is a plan view of a phaser according to an aspect of the present disclosure.

FIG. 2 is a partially schematic representation of camshaft phaser 10 having a warmup bypass circuit according to an aspect of the present disclosure. Phaser 10 has a rotor, 32, which, as noted above, is rotationally coupled and locked to camshaft 24. In other words, camshaft and rotor 32 rotate at the same speed. A hydraulic positioning system times, or positions, rotor 32 and camshaft 24 with respect to crankshaft 20. The disclosed hydraulic positioning system includes a number of working chambers, 52, formed in phaser housing 16. Working chambers 52 house a number of lobes, 34, which are in turn part of rotor 32. Phaser housing 16 is driven rotationally by chain 28.

Figure 3:
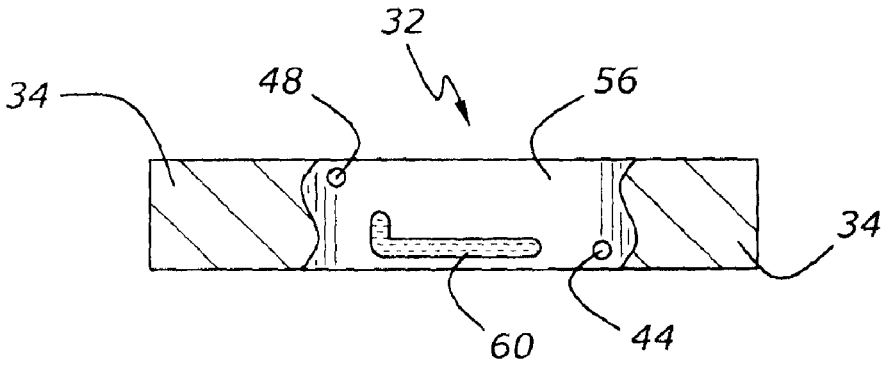
FIG. 3 is a sectional view of a rotor as shown in FIG. 2, taken along the line 3-3 of FIG. 2.

Rotor 32 and camshaft 24 are advanced or retarded in terms of their timing with respect to crankshaft 20 by engine oil which is supplied to the appropriate side of one of working chambers 52 by passages 44 and 48, which are shown in FIG. 3, with only passages 44 being shown in FIG. 2. Passages 44 and 48 extend radially from a control bore, 40, which receives oil from engine oil inlet 36, and which contains a valve spool (not shown). Passages 44 and 48 are arranged so that when oil flows through passages 44, rotor 32 will be caused to move anticlockwise with respect to housing 16 of phaser 10, as viewed from the front of phaser 10, with rotor 32 being caused to move clockwise with respect to housing 16 when fluid is introduced into working chambers 52 through passages 48. Because flexible drive element 28 is inextensible, any change in the rotational positioning of camshaft 24 with respect to phaser housing 16 results in a change of camshaft and cylinder valve timing.

Details of a bypass circuit which permits hydraulic fluid to flow through at least a portion of phaser 10 without affecting the timing of the camshaft with respect to the crankshaft are shown in FIGS. 2, 3, 4, 5 and 6. Beginning with FIG. 2, it is seen that the bypass circuit includes a bypass passage, 60, which is formed as an open channel on the surface of the root diameter, 56, of rotor 32. Thus, when bypass passage 60 is active, oil is free to flow through one of passages 44, through bypass passage 60, and then through vent port 64 which is formed radially through housing 16 of phaser 10. In this manner, oil which would otherwise be trapped within one of working chambers 52 is allowed to leave phaser 10, with the oil being flushed from working chamber 52 by warmer engine oil, thereby providing a fully warmed oil supply to working chamber 52. Those skilled in the art will appreciate in view of this disclosure that phaser 10 does not use hydraulic pressure to move, or re-position rotor 32 and camshaft 24 with respect to housing 16.

Those skilled in the art will further appreciate in view of this disclosure that additional bypass passages 60 and vent ports 64 could be provided for more than one of working chambers 52. The need for such additional bypass passages and vent ports is contingent upon the ability of a single chamber to warm phaser 10 adequately to avoid problems arising from oil that is too cold to respond properly to a phaser change command.

Figure 4:
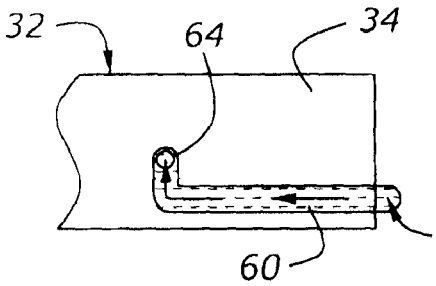
FIG. 4 is a fragment view of a portion of a rotor 32, showing a bypass passage according to an aspect of the present disclosure.
Figure 5:
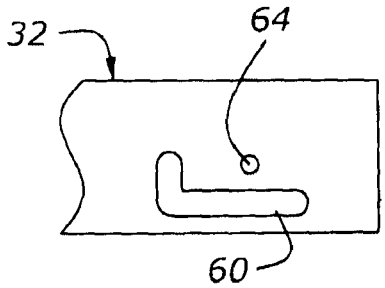
FIG. 5 illustrates the bypass passage of FIG. 4, with rotor 34 being in a different position than that shown in FIG. 4.

FIG. 3 shows bypass passage 60 as being formed in the outer surface of root diameter 56 of rotor 32. In FIG. 4, bypass passage 60 is shown as being lined up with vent port 64, thereby allowing oil to flow outward through vent port 64 (see also, FIG. 2). In FIG. 5, rotor 32 is in a position in which vent port 64 is not indexed with bypass passage 60, and as a result, oil is not permitted to leave working chamber 52 through vent port 64.

Figure 6:
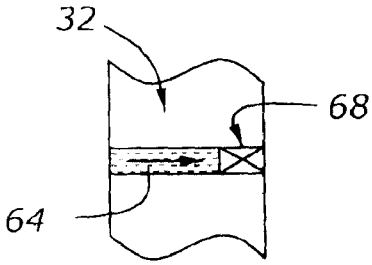
FIG. 6 illustrates an additional valving aspect according to the present disclosure.

FIG. 6 illustrates vent port 64 as being equipped with a check valve, 68, which may be advantageous with certain types of phasers according to the present disclosure.

Figure 7:
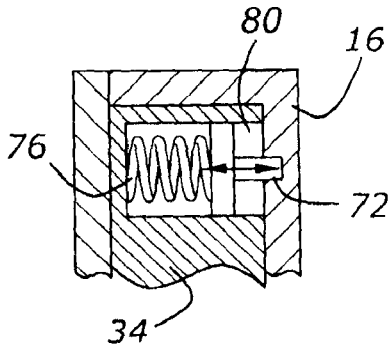
FIG. 7 shows a rotor locking pin according to an aspect of the present disclosure.

According to another aspect of the present disclosure, rotor 32 is preferably maintained in a locked position by a mechanical locking device when it is in the oil bypass mode illustrated in FIGS. 2 and 3. This means that rotor 32 will not rely upon hydraulic positioning during purging of cold oil, thereby allowing purging to occur without having any effect on camshaft timing. FIG. 7 shows an example of a rotor locking pin, 72, which is loaded by spring 76 into a locking position with housing 16. Pin 72 is slidably retained within one of lobes 34 and is released when oil pressure is applied to working chamber 80.

The foregoing embodiments have been described in accordance with the relevant legal standards, thus the description is exemplary rather than limiting in nature. Variations and modifications to the disclosed embodiments may become apparent to those skilled in the art and fall within the scope of the claims.

What is claimed is:

1. A camshaft phaser for an internal combustion engine, comprising:

a rotor which is rotationally coupled to a camshaft;

a hydraulic positioning system for timing said rotor and said camshaft with respect to a crankshaft of an engine; and a bypass circuit for permitting hydraulic fluid to flow through at least one working chamber and out of said phaser without affecting the timing of the camshaft with respect to the crankshaft.

2. A camshaft phaser according to claim 1, wherein said hydraulic positioning system comprises a hydrostatic positioning system.

3. A camshaft phaser according to claim 1, wherein said bypass circuit is active only when the rotor and camshaft have been placed in one or more preselected rotational positions with respect to the crankshaft.

4. A camshaft phaser according to claim 1, wherein said hydraulic fluid comprises oil flowing through a lubrication system of the engine.

5. A camshaft phaser according to claim 1, further comprising a mechanical locking device for maintaining the rotor and camshaft at a predetermined timing value with respect to the crankshaft when said bypass circuit is active to permit hydraulic fluid to flow through the phaser.

6. A camshaft phaser for an internal combustion engine, comprising:

a rotor which is rotationally coupled to a camshaft;

a hydrostatic positioning system for positioning said rotor and said camshaft in a plurality of predetermined rotational positions with respect to a crankshaft of an engine; and a bypass circuit for permitting engine lubricating oil to flush through at least one working chamber of said phaser and out of the phaser without affecting the positioning of the camshaft and rotor with respect to the crankshaft.

7. A method for operating a camshaft phaser for an internal combustion engine, comprising:

determining engine operating temperature;

in the event that engine temperature is less than a predetermined value, maintaining a hydrostatically controlled phaser in a predetermined cold operating position; and flushing a warming fluid through at least one working chamber of the phaser and out of the phaser at least when the phaser is being maintained in the cold operating position.

8. A method according to claim 7, wherein said warming fluid comprises oil flowing through a lubricating oil system.

* * * * *